US009954309B2

(12) United States Patent
Eid et al.

(10) Patent No.: US 9,954,309 B2
(45) Date of Patent: Apr. 24, 2018

(54) MAGNETIC DETACHABLE ELECTRICAL CONNECTIONS BETWEEN CIRCUITS

(71) Applicant: Intel Corporation, Santa Clara, CA (US)

(72) Inventors: Feras Eid, Chandler, AZ (US); Sasha N. Oster, Chandler, AZ (US); Adel A. Elsherbini, Chandler, AZ (US); Aleksandar Aleksov, Chandler, AZ (US); Johanna M. Swan, Scottsdale, AZ (US); Amit Sudhir Baxi, Bangalore (IN); Vincent S. Mageshkumar, Navi Mumbai (IN)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/215,531

(22) Filed: Jul. 20, 2016

(65) Prior Publication Data

US 2018/0026393 A1 Jan. 25, 2018

(51) Int. Cl.
*H01R 11/30* (2006.01)
*H01R 13/60* (2006.01)
(Continued)

(52) U.S. Cl.
CPC ..... *H01R 13/6205* (2013.01); *H01R 13/627* (2013.01); *H01R 13/631* (2013.01)

(58) Field of Classification Search
CPC .. H01R 11/30; H01R 13/6205; A61B 5/04087
(Continued)

(56) References Cited

U.S. PATENT DOCUMENTS 4,067,342 A * 1/1978 Burton ..... A61B 5/04087 607/148
4,259,965 A * 4/1981 Fukuda ..... A61B 5/0408 600/392

(Continued)

FOREIGN PATENT DOCUMENTS

WO WO-03065926 A2 8/2003
WO WO-2009036327 A1 3/2009
WO WO-2016010983 A1 1/2016

OTHER PUBLICATIONS

"U.S. Appl. No. 15/216,502, Examiner Interview Summary dated Feb. 1, 2017", 3 pgs.

(Continued)

*Primary Examiner* — Hae Moonhyeon
(74) *Attorney, Agent, or Firm* — Schwegman Lundberg & Woessner, P.A.

(57) ABSTRACT

Discussed generally herein are methods and devices including or providing a magnetic, detachable, conductive connector to provide an electrical and mechanical connection between parts. A device can include a first substrate, at least one electric component on or at least partially in a first surface of the first substrate, an adhesive on the first surface of the first substrate to temporarily attached the device to skin of a user, a contact pad electrically coupled to an electric component of the at least one electric component, the contact pad on or at least partially in a second surface of the substrate, the first surface opposite the second surface, and a conductive magnetic connector electrically and mechanically connected to the contact pad through a first conductive adhesive.

20 Claims, 6 Drawing Sheets

(51) Int. Cl.
*H01R 13/62* (2006.01)
*H01R 13/627* (2006.01)
*H01R 13/631* (2006.01)

(58) Field of Classification Search
USPC ..... 439/38, 39
See application file for complete search history.

(56) References Cited

U.S. PATENT DOCUMENTS 5,499,927 A 3/1996 Ohno et al.
5,507,303 A * 4/1996 Kuzma ..... A61N 1/05 128/899
6,096,066 A 8/2000 Chen et al.
6,496,705 B1 12/2002 Ng et al.
6,697,262 B2 * 2/2004 Adams ..... B60K 37/02 361/730
7,524,195 B2 * 4/2009 Ales ..... H01R 13/03 439/66
7,637,747 B2 * 12/2009 Jaatinen ..... A61B 5/0408 439/39
9,391,394 B2 * 7/2016 Kockx ..... A61N 1/048
9,735,893 B1 8/2017 Aleksov et al.
2006/0197213 A1 * 9/2006 Lian ..... G06K 19/07749 257/687
2006/0224067 A1 10/2006 Giftakis et al.
2006/0252284 A1 11/2006 Marmaropoulos et al.
2007/0100219 A1 5/2007 Sweitzer et al.
2007/0129776 A1 6/2007 Robins et al.
2008/0004515 A1 1/2008 Jennewine
2009/0054737 A1 2/2009 Magar et al.
2009/0076363 A1 3/2009 Bly et al.
2009/0076559 A1 3/2009 Libbus et al.
2009/0131838 A1 5/2009 Fotiadis et al.
2009/0182393 A1 7/2009 Bachinski
2010/0304530 A1 12/2010 Yim et al.
2012/0157807 A1 6/2012 Virtanen et al.
2012/0238890 A1 9/2012 Baker et al.
2012/0295451 A1 * 11/2012 Hyun-Jun ..... H01R 13/6205 439/39
2013/0030259 A1 1/2013 Thomsen et al.
2013/0065406 A1 3/2013 Rohrbach et al.
2013/0109937 A1 5/2013 Banet et al.
2013/0111710 A1 5/2013 Hunts
2013/0166006 A1 6/2013 Williams
2013/0273752 A1 * 10/2013 Rudisill ..... H01R 13/6205 439/39
2014/0162468 A1 * 6/2014 Kim ..... H01R 13/6205 439/39
2015/0087949 A1 3/2015 Felix et al.
2015/0150502 A1 6/2015 Wu
2015/0303619 A1 * 10/2015 Kockx ..... A61N 1/048 607/149
2016/0045135 A1 2/2016 Kim et al.
2016/0099517 A1 * 4/2016 Fernandes ..... H01R 12/79 439/39
2016/0121098 A1 * 5/2016 Kockx ..... H01R 13/506 607/115
2016/0172320 A1 6/2016 Swaminathan et al.
2016/0181729 A1 * 6/2016 Barth ..... A41D 1/005 439/37
2016/0296159 A1 10/2016 Larson et al.

OTHER PUBLICATIONS

"U.S. Appl. No. 15/216,502, Non Final Office Action dated Dec. 15, 2016", 15 pgs.
"U.S. Appl. No. 15/216,502, Notice of Allowance dated Apr. 5, 2017", 5 pgs.
"U.S. Appl. No. 15/216,502, Response filed Feb. 17, 2017 to Non Final Office Action dated Dec. 15, 2016", 11 pgs.
"U.S. Appl. No. 15/281,814, Non Final Office Action dated Apr. 10, 2017", 10 pgs.
"U.S. Appl. No. 15/281,814, Response to Non Final Office Action dated Apr. 10, 2017", 5 pgs.
"International Application Serial No. PCT/US2016/040476, International Search Report dated Jan. 10, 2017", 4 pgs.
"International Application Serial No. PCT/US2016/040476, Written Opinion dated Jan. 10, 2017", 8 pgs.
"Listen to Your Heart Arrythmias", iRhythm Technologies, [Online]. Retrieved from the Internet: <URL: http://www.irhythmtech.com/patients-heart-arrhythmias-afib.php, (Accessed Mar. 31, 2016), 5 pgs.
"SEEQ™ Mobile Cardiac Telemetry (MCT) Device", [Online]. Retrieved from the Internet: <URL: http://www.medtronicdiagnostics.com/us/cardiac-monitors/seeq-mct-system/seeq-mct-device/index.htm, (Accessed Mar. 31, 2016), 4 pgs.
Andrew, A. Kostrzewski, et al., "Innovative, wearable snap connector technology for improved networking in electronic garments".
"International Application Serial No. PCT/US2017/037298, International Search Report dated Aug. 14, 2017", 4 pgs.
"International Application Serial No. PCT/US2017/037298, Written Opinion dated Aug. 14, 2017", 7 pgs.
"International Application Serial No. PCT/US2017/037301, International Search Report dated Sep. 8, 2017", 3 pgs.
"International Application Serial No. PCT/US2017/037301, Written Opinion dated Sep. 8, 2017", 8 pgs.
"U.S. Appl. No. 15/281,814, Notice of Allowance dated Nov. 6, 2017", 7 pgs.
"U.S. Appl. No. 15/676,611, Examiner Interview Summary dated Nov. 8, 2017", 3 pgs.
"U.S. Appl. No. 15/676,611, Non Final Office Action dated Sep. 5, 2017", 6 pgs.
"U.S. Appl. No. 15/676,611, Response Filed Nov. 6, 2017 to Non Final Office Action dated Sep. 5, 2017", 8 pgs.
U.S. Appl. No. 15/676,611, filed Aug. 14, 2017, Patch System for In-Situ Therapeutic Treatment.

* cited by examiner

MAGNETIC DETACHABLE ELECTRICAL CONNECTIONS BETWEEN CIRCUITS

TECHNICAL FIELD

This disclosure relates generally to providing a conductive, detachable interconnect between circuits using one or more magnets.

BACKGROUND ART

Conductive interconnects have been provided by solder or other conductive adhesive, mechanical snaps with conductive material (e.g., conductive wires) extending therethrough, and/or conductive mechanical snaps. Such prior conductive interconnects are generally not easy to disconnect and/or re-connect.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DESCRIPTION OF EMBODIMENTS

Figure 1:
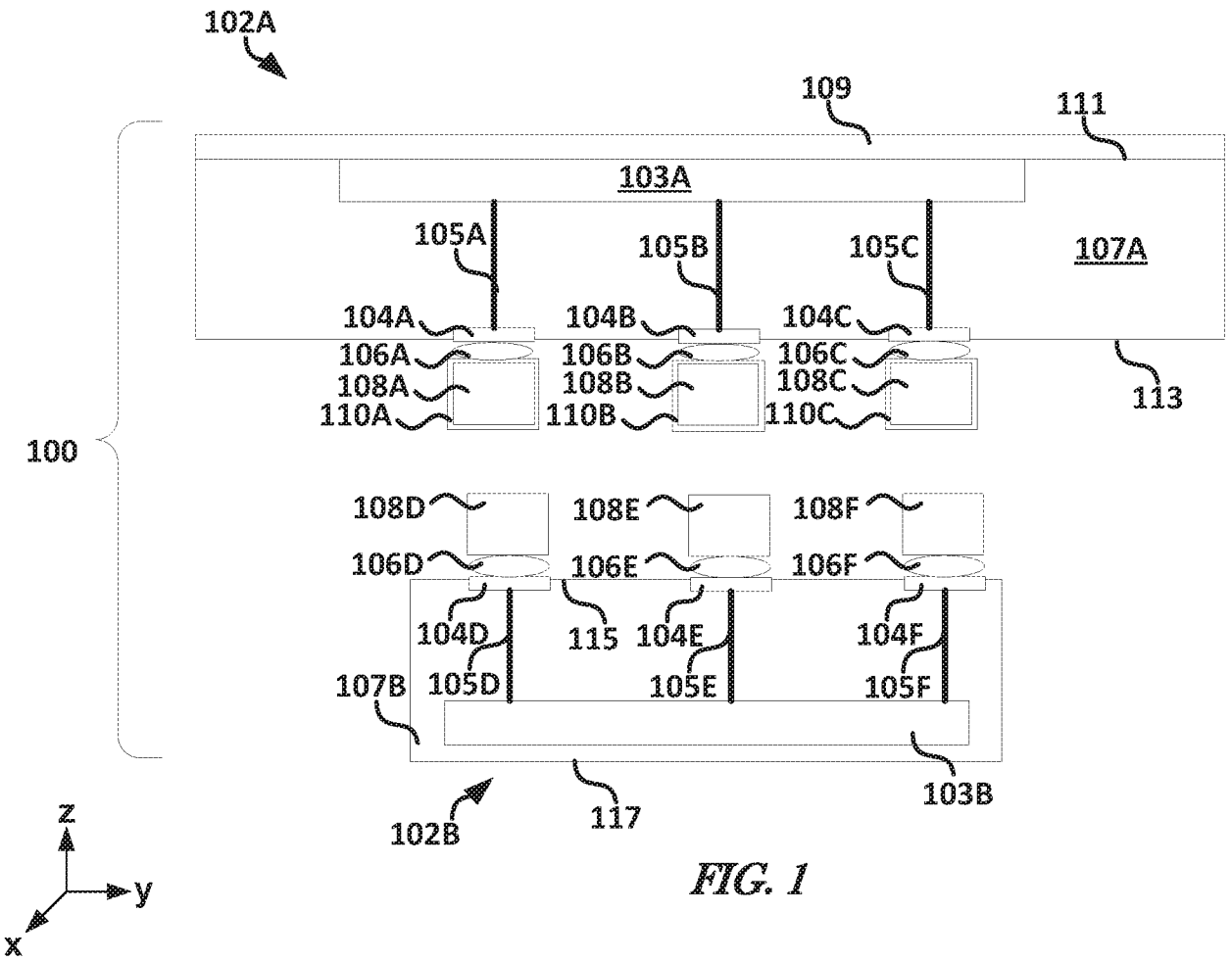
FIG. 1 illustrates, by way of example, a perspective view diagram of an embodiment of a system with magnetic, conductive interconnects.

The following description and the drawings sufficiently illustrate embodiments to enable those skilled in the art to practice them. Other embodiments can incorporate structural, logical, electrical, process, or other changes. Portions and features of some embodiments can be included in, or substituted for, those of other embodiments. Embodiments set forth in the claims encompass all available equivalents of those claims.

Many internet of things (IoT) systems are emerging that have multiple components which require detachable electrical connectors that can be easily manipulated by the user. One example is any system that contains both disposable and reusable components. For example, a health monitoring system may include a disposable part that is placed in continuous contact with the skin for measuring one or more biological parameters (e.g., biological indicator(s), biological function(s), or the like), such as electrocardiogram (ECG), respiration rate, and/or many others. Such a monitoring system can be disposed of every few days due to skin shedding or desquamation. In one or more embodiments, the disposable part may include a strip that receives a sample of blood or sweat from the user for chemical analysis and needs to be thrown away after each use. A reusable part of the system may contain more expensive components that are not irreversibly impacted during use, such as a processor, communication circuitry, sensor(s), and/or a battery, among other circuitry. Those systems can include connectors that can connect the disposable part to the reusable part. The reusable and disposable parts can be frequently attached or disconnected by the user, such as without requiring sending the parts back to the vendor, such as by using the connectors. One or more embodiments discussed herein provide new methods and architectures for providing the connector functionality.

Some wearable connectors for stretchable and/or flexible skin contact applications include conductive snaps, conductive Velcro, or thread-through conductive rings. Snaps consume a large area on the device especially when several contacts are used. Also, the snaps have a relatively large Z-height which impacts fabricating devices that are discreet and impact user comfort. Conductive Velcro requires relatively large area on the substrate which can result in larger system size when several connections are used. Furthermore, conductive Velcro cannot be easily designed to avoid user error (the user might assume that all the contacts are made when only one side or one Velcro patch is connected). Note that Velcro is just one example of a fabric hook and loop fastener. Thread through conductive rings form permanent attach and the threads must be cut to release the device which significantly complicates an attach and detach processes performed by the user.

Discussed herein are devices that include magnets which are either inherently, sufficiently electrically conductive and/or are coated with electrically conductive material to enable detachable, conductive, magnetic connectors.

Embodiments discussed herein use magnets to help enable detachable, conductive connectors. The magnets can be attached to respective electrical traces, pads, or other conductive material in the substrate or printed circuit board (PCB) of each of the parts of the system that are to be connected or disconnected. An electrically conductive medium such as solder, conductive epoxy, anisotropic conductive film, or the like can be used to form a permanent or temporary electrical or mechanical connection between each magnet and the trace or pad to be connected. To help ensure an electrical path exists for the signals from/to those traces, pads, or conductive material, the magnet material itself can be electrically conductive or the magnet can be coated with an electrically conductive material.

FIG. 1 illustrates, by way of example, a perspective view diagram of a system 100 that includes multiple devices 102A and 102B with mating detachable, conductive, magnetic connectors 108A, 108B, 108C, 108D, 108E, and 108F. In the system 100 the magnetic connector 108A or 108C of the device 102A can mate with the magnetic connector 108D or 108F of the device 102B and the magnetic connector 108B of the device 102A can mate with the magnetic connector 108E of the device 102B. The device 102A as illustrated includes an adhesive 109 on a first surface 111 of a substrate 107A. The first surface 111 is opposite a second surface 113 of the substrate 107A. The device 102B as illustrated includes pads 104D, 104E, and 104F on or at least partially in a first surface 115 of a substrate 107B. The first surface 115 is opposite a second surface 117.

In one or more embodiments, one of the devices 102B can be reusable and the other device 102A can be disposable. In one or more embodiments, a reusable device can include a rigid and/or flexible circuit, such as is described in Patent Cooperation Treaty (PCT) Patent Application PCT/US2016/040476, titled "Devices and Methods for Sensing Biologic Function", and filed on Jun. 30, 2016, which is incorporated herein by reference in its entirety. In one or more embodiments, the disposable device can include a stretchable, flexible substrate with circuitry thereon that can monitor a biological parameter, such as is described in the PCT Application.

The disposable device can be configured to be in contact with and/or attached to the skin of an entity to wear the device. The disposable device can include circuitry to provide electrical signals that can be used (e.g., by the reusable device) to monitor a biological parameter of the user.

The biological parameter can include one or more of muscular activity of the heart (e.g., using signals from an ECG), electrical activity of the heart (e.g., using signals from an ECG), muscular flexion, muscular contraction, muscular flexibility, and/or muscular stretch (e.g., using a stretch sensor), temperature (e.g., using a resistance temperature detector), muscular electrical activity (e.g., using electromyography (EMG)), breathing rate or breathing volume (e.g., using a stretch sensor), range of motion (e.g., using a stretch sensor), specific force, angular rate, and/or magnetic field (e.g., using an inertial measurement unit (IMU)), lactate content in a muscle (e.g., using a lactate sensor), salinity content (e.g., using a salinity sensor), organ or conduit (e.g., artery or vein) volume (e.g., using a photoplethysmogram (PPG), such as can include a pulse oximeter), blood pressure (e.g., using a combination of PPG and ECG), blood glucose level (e.g., using a device to prick the skin and expose blood to a blood glucose monitor), and/or posture (e.g., using one or more stretch sensors and/or IMUs).

The device 102A as illustrated includes electronics 103A electrically coupled to one or more pads 104A, 104B, and 104C through electrical interconnect circuitry 105A, 105B, and 105C. The electronics 103A can include one or more traces, pads, or components (e.g., resistor, capacitor, transistor, inductor, diode, regulator, sensor (e.g., a temperature sensor, oxygen sensor, stretch sensor, inertial measurement unit (IMU) sensor, and/or electrocardiogram (ECG) sensor, electromyography (EMG) sensor, audio sensor (e.g., microphone could potentially detect heart beat), pressure sensor (e.g., piezo sensor could pick up pulse, heartbeat, fetal movement, etc.), ultrasonic sensor (paired with ultrasound emitter could be used for imaging, heartbeat, fetal features, etc.); chemical sensors such as a salinity or a lactate sensor, optical sensors (to obtain information about levels of certain enzymes/chemicals in blood), among others), a pulse oximeter, a blood glucose monitor, accelerometer, optical component (e.g., a light emitting diode (LED)), multiplexer, processor, memory, battery, antenna, modulator/demodulator, radio (e.g., receive or transmit radio or a transceiver), and/or amplifier, or the like) arranged and/or connected to create electrical signals indicative of a biological parameter to be monitored.

The electronics 103A can be on or at least partially in the substrate 107A of the device 102A. The substrate 107A can include a flexible and/or stretchable material, such as can include an elastomer, spandex, woven fabric, plastic (e.g., polyvinyl chloride (PVC), polyethylene, and/or polyurethane), TPU (thermoplastic polyethylene), polydimethylsiloxane (PDMS) (silicone), latex, or a combination thereof, among others.

The electrical interconnect circuitry 105A-C can include one or more traces, pads, vias, or other conductive interconnect circuitry to provide an electrical connection between the pads 104A-C and the electronics 103A. A conductive adhesive 106A-C can electrically connect the pads 104A-C to magnetic connectors 108A, 108B, and 108C, respectively. The magnetic connectors 108A-C as illustrated include a conductive material 110A, 110B, and 110C attached thereto. The conductive material 110A-C can provide an electrical path for a signal to travel from the electronics 103A to the device 102B, such as in embodiments in which the magnetic connectors 108A-C are not sufficiently conductive. In embodiments in which the magnetic connectors 108A-C are sufficiently conductive, the conductive material 110A-C can be superfluous and not used.

The conductive adhesive 106A-C can include a solder, epoxy with silver or other conductive material, or other conductive adhesive 106A-C. The conductive adhesive 106A-C provides an electrical path between objects connected thereto.

The magnetic connectors 108A-C produce a magnetic field, attract magnetic connectors that include a magnetic field of an opposite polarity, and repel magnetic connectors that include a magnetic field of a same polarity. The magnetic connectors 108A-C can include a material, such as aluminum, iron, nickel, cobalt, lodestone, alnico, ferrite, a combination thereof, or an electromagnet, among others.

The adhesive 109 can at least temporarily affix the device 102A to a surface, such as the skin of a user or other surface. The adhesive 109 can include a doublesided tape or an acrylate (e.g., methacrylate or epoxy diacrylate, among others), among others.

The conductive material 110A-C can provide a conductive path for an electrical signal to travel between the electronics 103A and the electronics 103B. The conductive material 110A-C can include a same or different material as the conductive adhesive 106A-C. The conductive material 110A-C can be non-ferrous or sufficiently non-ferrous so as to not sufficiently impact the magnetic property of the magnetic connector 108A-C. The conductive material 110A-C can be sufficiently thin so as to not sufficiently impact the magnetic property of the magnetic connector.

The device 102B is similar to the device 102A. The electronics 103B can include one or more of a processor, memory, power delivery circuitry, a power supply, a feedback indicator, or other electrical or electronic components, such as traces, pads, or components (e.g., resistor, capacitor, transistor, inductor, diode, regulator, an analog to digital converter (ADC), optical component (e.g., an LED), multiplexer, antenna, modulator/demodulator, radio (e.g., receive or transmit radio or a transceiver), and/or amplifier, or the like. The electronics 103B include, generally, any electric or electronic components that are not in contact with or near the skin of the user that wears the system 100. It can be advantageous to locate components on/in the reusable device 102B so as to reduce the cost of the disposable device 102A.

The substrate 107B can be a flexible, stretchable, and/or rigid substrate. A rigid substrate can include an FR-4 or other similar printed circuit board (PCB). A flexible substrate can be made on a thin dielectric, such as polyimide, PEEK, of polyester. A flexible, stretchable substrate can include one or more materials as discussed with regard to the substrate 107A.

The conductive interconnects 105D, 105E, and 105F are similar to the conductive interconnects 105A-C. The pads 104D, 104E, and 104F are similar to the pads 104A-C. The conductive adhesives 106D, 106E, and 106F are similar to the conductive adhesives 106A-C. The magnetic connectors 108D, 108E, and 108F are similar to the magnetic connectors 108A-C, with the magnetic connectors 108D-F being of opposite polarity from the magnetic connectors 108A-C, respectively, such that the magnetic connectors 108A and 108D can mate, the magnetic connectors 108B and 108E can mate, and the magnetic connectors 108C and 108F can mate. The combination of the magnetic matings (or a singular mating between one of the mating magnetic connector pairs) can form a connection with force sufficient to hold the device 102B in place and form reliable electrical connection(s) between the electronics 103A and the electronics 103B.

As illustrated, the magnetic connectors 108A-F can be attached to a respective trace, pad 104A-F, or other conductive material in/on the devices 102A-B of the system 100 that are to be connected or disconnected. The trace, pad, or other conductive material can be part of or attached to a printed circuit board (PCB) (e.g., the substrate 107B) or the substrate 107A. The magnetic connectors 108A-F can be attached using an electrically conductive adhesive 106A-F, such as solder or a conductive epoxy. When the magnetic connectors 108A-F of respective devices 102A-B are brought into proximity of each other, the magnetic connectors 108A-C and 108D-F respectively form a connection (e.g., north polarization and south polarization magnetic connectors connect with each other) creating a continuous electrical path for electrical signals and/or electrical power between the electronics 103A and 103B. In one or more embodiments, the top device 102A can include a stretchable fabric material and the bottom device 102B includes a flexible or rigid PCB.

Figure 2:
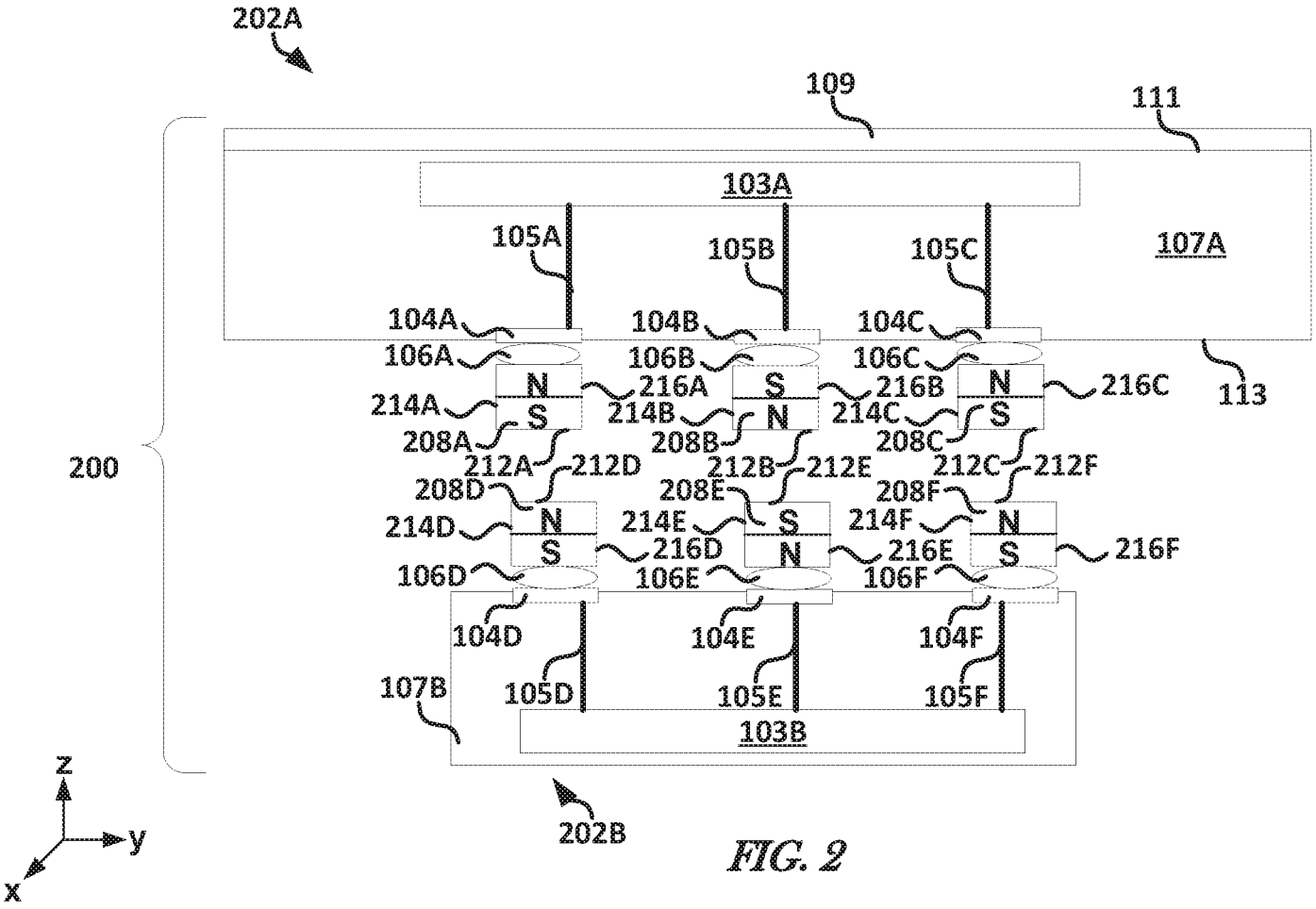
FIG. 2 illustrates, by way of example, a perspective view diagram of another embodiment of a system with magnetic, conductive interconnects.

FIG. 2 illustrates, by way of example, a perspective view diagram of an embodiment of a system 200 that includes conductive, detachable, magnetic connectors. The system 200 as illustrated includes device 202A and 202B that are similar to the devices 102A-B, with the devices 202A-B including bipolar magnetic connectors 208A-F whose magnetization is in the vertical direction (i.e. normal to the surfaces of the pads 104A-F).

The magnetic connectors 208A-F are configured such that attractive forces are generated in the locations where an electrical connection between the two devices 202A-B is desired, and zero or repulsive forces are generated in the locations where no connection is desired. For example, in FIG. 2, because of the orientation of the north and south poles of each magnetic connector 208A-F, directly adjacent magnetic connectors on the same device 202A-B will repel (e.g., the magnetic connector 208D will repel the magnetic connector 208E, which will repel the magnetic connector 208F and so forth). Some magnetic connectors will be attracted to each other (where a connection is desired) if they are brought close to each other and the magnetic connectors are of opposite polarity. The magnetic connector 208A can form a magnetic and electrical connection with the magnetic connector 208D or 208F, the magnetic connector 208B can form a magnetic and electrical connection with the magnetic connector 208E, and the magnetic connector 208C can form a magnetic and electrical connection with the magnetic connector 208D or 208F. If magnetic connectors of same polarity (e.g., one north and another north) are brought close to each other, such as by mistake, a repulsive force is generated between the two, ensuring no electrical or magnetic connection is formed.

The orientation of the bipolar magnetic connectors 208A-F helps ensure that the magnetic connectors 208A-F form a magnetic and electrical connection at a surface 212A, 212B, 212C, 212D, 212E, and 212F of the magnetic connectors 208A-F facing each other. The orientation of the bipolar magnetic connectors 208A-F helps ensure that the magnetic connectors 208A-F repel each other on sides 214A, 214B, 214C, 214D, 214E, 214F, 216A, 216B, 216C, 216D, 216E, and 216F of the magnetic connectors 208A-F. The magnetic connectors 208C and 208F will repel each other if either of the sides 214C and 216C are in proximity to the sides 214F and 216F, but the magnetic connectors 208C and 208F will form a magnetic and electrical connection if the surfaces 212C and 212F are in proximity with each other.

Figure 3:
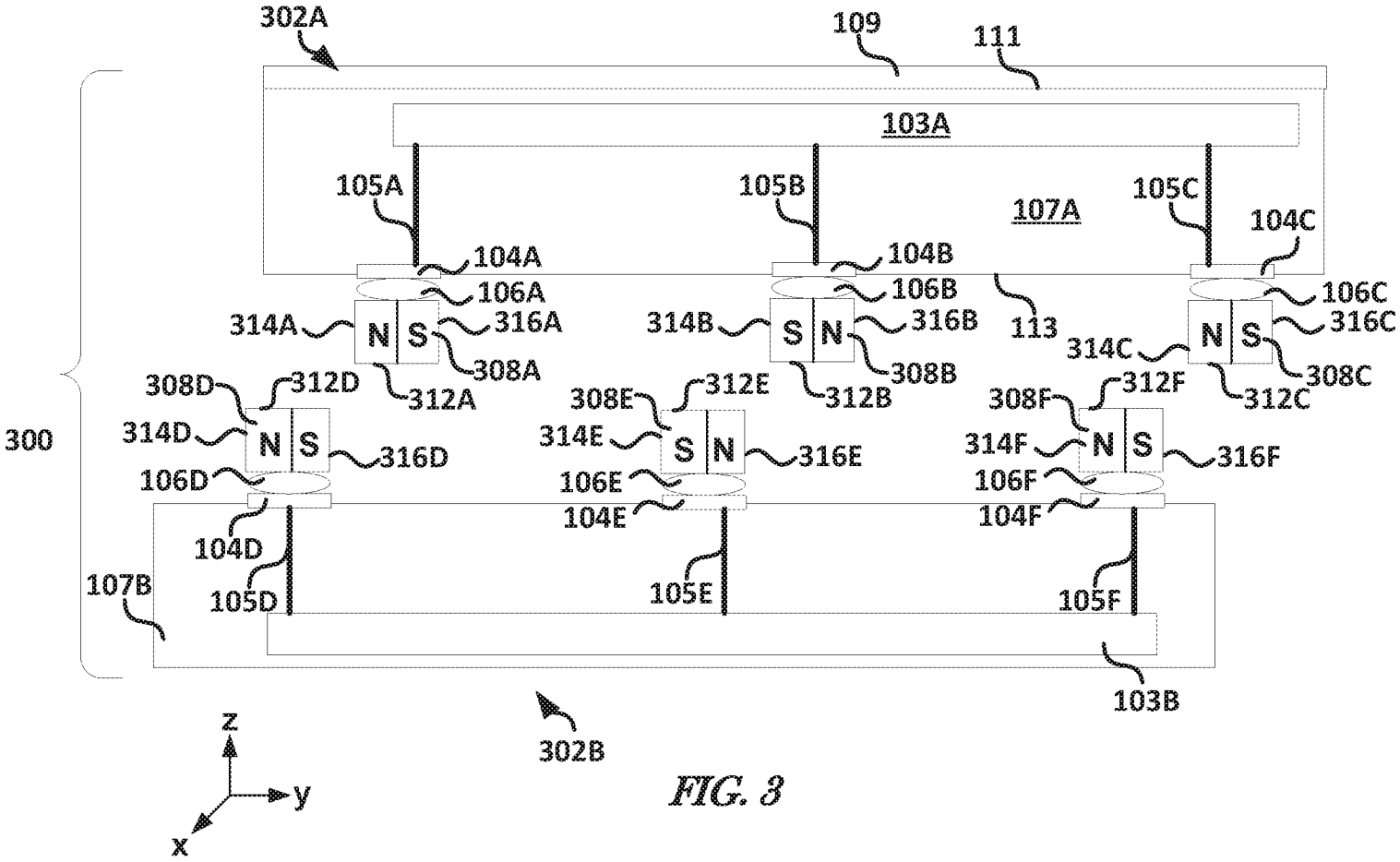
FIG. 3 illustrates, by way of example, a perspective view diagram of an embodiment of a system with magnetic, conductive interconnects.

FIG. 3 illustrates, by way of example, a perspective view diagram of an embodiment of a system 300 that includes conductive, detachable, magnetic connectors. The system 300 as illustrated includes device 302A and 302B that are similar to the devices 202A-B, with the devices 302A-B including bipolar magnetic connectors 308A-F whose magnetization is in the horizontal direction (i.e. parallel to the surfaces of the pads 104A-F). The magnetic connectors 308A-F are oriented to connect on sides 314A, 314B, 314C, 314D, 314E, 314F, 316A, 316B, 316C, 316D, 316E, and 316F instead of on the surface 212A-F (as in the system 200).

The magnetic connectors 308A-F are configured such that attractive forces are generated in the locations where an electrical connection between the two devices 302A-B is desired, and zero or repulsive forces are generated in the locations where no connection is desired. For example, in FIG. 3, because of the orientation of the north and south poles of each magnetic connector 308A-F, directly adjacent magnets on the same device 302A-B will repel (e.g., the magnetic connector 308D will repel the magnetic connector 308E, which will repel the magnetic connector 308F and so forth). Some magnetic connectors will be attracted to each other (where a connection is desired) if they are brought close to each other and the proximate portions of the magnetic connectors are of opposite polarity. The magnetic connector 308A can form a magnetic and electrical connection with the magnetic connector 308D or 308F, such as on sides 314A or 316A and 316D or 314D, respectively, or 314A or 316A and 316F or 314F, respectively and not on the surface 312A and 312D. The magnetic connector 308B can form a magnetic and electrical connection with the magnetic connector 308E, such as at sides 314B or 316B and 316E or 314E, respectively. The magnetic connector 308C can form a magnetic and electrical connection with the magnetic connector 308D or 308F, such as at sides 314C or 316C and 316D or 314D, respectively, or 314C or 316C and 316F or 314F, respectively. If magnetic connectors of same polarity (e.g., one north and another north) are brought close to each other, such as by mistake, a repulsive force is generated between the two, ensuring no electrical or magnetic connection is formed.

The orientation of the bipolar magnetic connectors 308A-F, unlike the magnetic connectors 208A-F, helps ensure that the magnetic connectors 308A-F do not form a magnetic and electrical connection at a surface 312A, 312B, 312C, 312D, 312E, and 312F of the magnetic connectors 308A-F facing each other. The orientation of the bipolar magnetic connectors 308A-F helps ensure that the magnetic connectors 308A-F attract each other, such as form magnetic and electrical connections, on sides 314A, 314B, 314C, 314D, 314E, 314F, 316A, 316B, 316C, 316D, 316E, and 316F of the magnetic connectors 308A-F. The magnetic connectors 308C and 308F will attract each other and form a magnetic and electrical connection if either of the sides 314C and 316C are in proximity to the sides 316F and 314F, but the magnetic connectors 308C and 308F will not form a magnetic and electrical connection if the surfaces 312C and 312F are in proximity with each other.

The connections on the sides, as in the embodiment of FIG. 3, are in-plane connections rather than across-thickness connections (as in the embodiment of FIG. 2). This can be advantageous in applications where the total z-height of the system 300 is constrained and needs to be kept lower. The magnetic connectors 308A-F are configured to produce attractive forces in the desired locations only, as is similar to the embodiment of FIG. 2.

In another embodiment, one or more other mechanical connectors, such as snaps or Velcro can be used to help provide a stronger mechanical connection. This can be used instead of relying solely on the magnetic connectors for mechanical robustness. The magnetic connectors can still be used to help provide alignment and accurate local electrical connections between the two parts after the global connections have been made. Example embodiments with such mechanical connections are shown in FIGS. 4 and 5.

Figure 4:
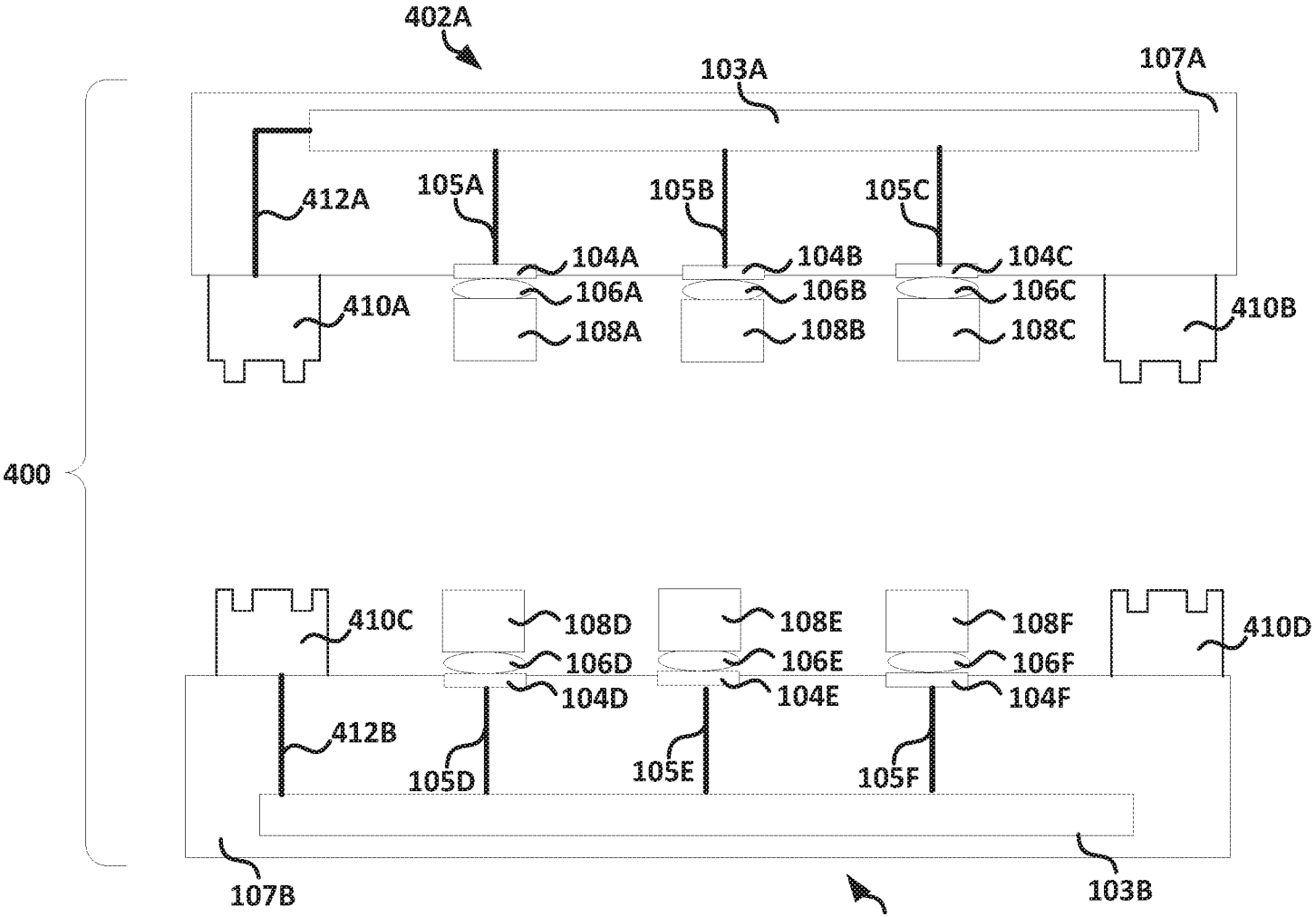
FIG. 4 illustrates, by way of example, a perspective view diagram of another embodiment of a system with magnetic, conductive interconnects.

FIG. 4 illustrates, by way of example, a perspective view diagram of an embodiment of a system 400 that includes conductive, detachable, magnetic connectors and snaps 410A, 410B, 410C, and 410D. The devices 402A-B are similar to the devices 102A-B, with the devices 402A-B including the snaps 410A-B and the mating snaps 410C-D, respectively. The snaps 410A-B, when mated with the snaps 410C-D, provide additional mechanical attachment between the devices 402A-B. The snaps 410A-D as illustrated are situated outside of the magnetic connectors 108A-F with the magnetic connectors 108A-F between the snaps 410A-D. In one or more embodiments, one or more of the snaps 410A-D can be situated between magnetic connectors 108A-F. In one or more embodiments, one or more of the snaps 410A-D can be conductive and can provide an electrical path between the electronics 103A and 103B as illustrated by electrical interconnect circuitry 412A and 412B. While the device 402A-B is illustrated as including the magnetic connectors 108A-F, the device 402A-B can include the magnetic connectors 202A-F or 302A-F.

Figure 5:
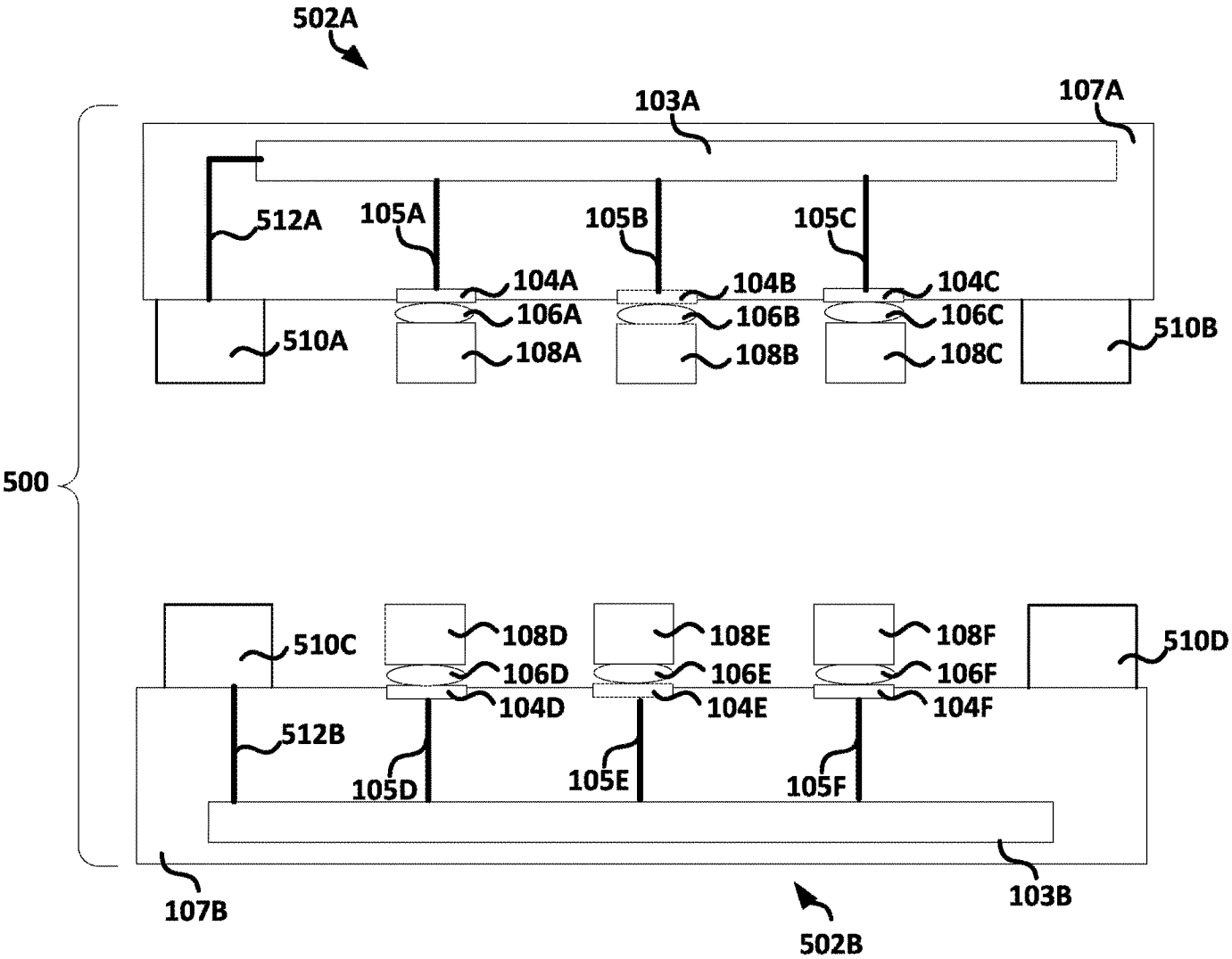
FIG. 5 illustrates, by way of example, a perspective view diagram of another embodiment of a system with magnetic, conductive interconnects.

FIG. 5 illustrates, by way of example, a perspective view diagram of an embodiment of a device that includes conductive, detachable, magnetic connectors and Velcro 510A-D (e.g., conductive or non-conductive Velcro). The devices 502A-B are similar to the devices 402A-B, with the devices 502A-B including the Velcro 510A-B and the mating Velcro 510C-D, respectively. The Velcro 510A-B, when mated with the Velcro 510C-D, provides additional mechanical attachment between the devices 502A-B. The Velcro 510A-D as illustrated is situated outside of the magnetic connectors 108A-F with the magnetic connectors 108A-F between the Velcro 510A-D. In one or more embodiments, one or more of the Velcro 510A-D can be situated between magnetic connectors 108A-F. In one or more embodiments, one or more of the Velcro 510A-D can be conductive and can provide an electrical path between the electronics 103A and 103B as illustrated by electrical interconnect circuitry 512A and 512B. While the device 502A-B is illustrated as including the magnetic connectors 108A-F, the device 502A-B can include the magnetic connectors 208A-F or 308A-F. In one or more embodiments, the magnetic connectors 108A-F, 208A-F, and/or 308A-F can be on the order of millimeters or even less than one millimeter in the x, y, and/or z directions.

Compared to existing connectors, the magnetic connectors discussed herein can provide one or more of the following advantages: (1) Simplifying and/or speeding up the attach and detach of the connector for the user; (2) Relatively strong magnetic connectors with relatively small Z-height (e.g., less than 0.2 mm) can be fabricated and assembled. This provides much smaller Z-height of the overall system, as compared to other connectors; (3) The magnetic connectors can also use smaller X and/or Y area compared to snaps. This allows an increase in connector density between the two substrates in a small overall area. (4) The magnetic connectors can be designed to require less force when detaching the two substrates compared to other connectors. This can reduce the mechanical stress in the substrate and improve the reliability of the product for many attach and detach cycles; and/or (5) Specifically when one of the substrates is stretchable or flexible, the magnetic connector dimensions can be chosen to allow extended contact when one of the substrates is stretching. This reduces the stress in the substrate area and allows better reliability.

Figure 6:
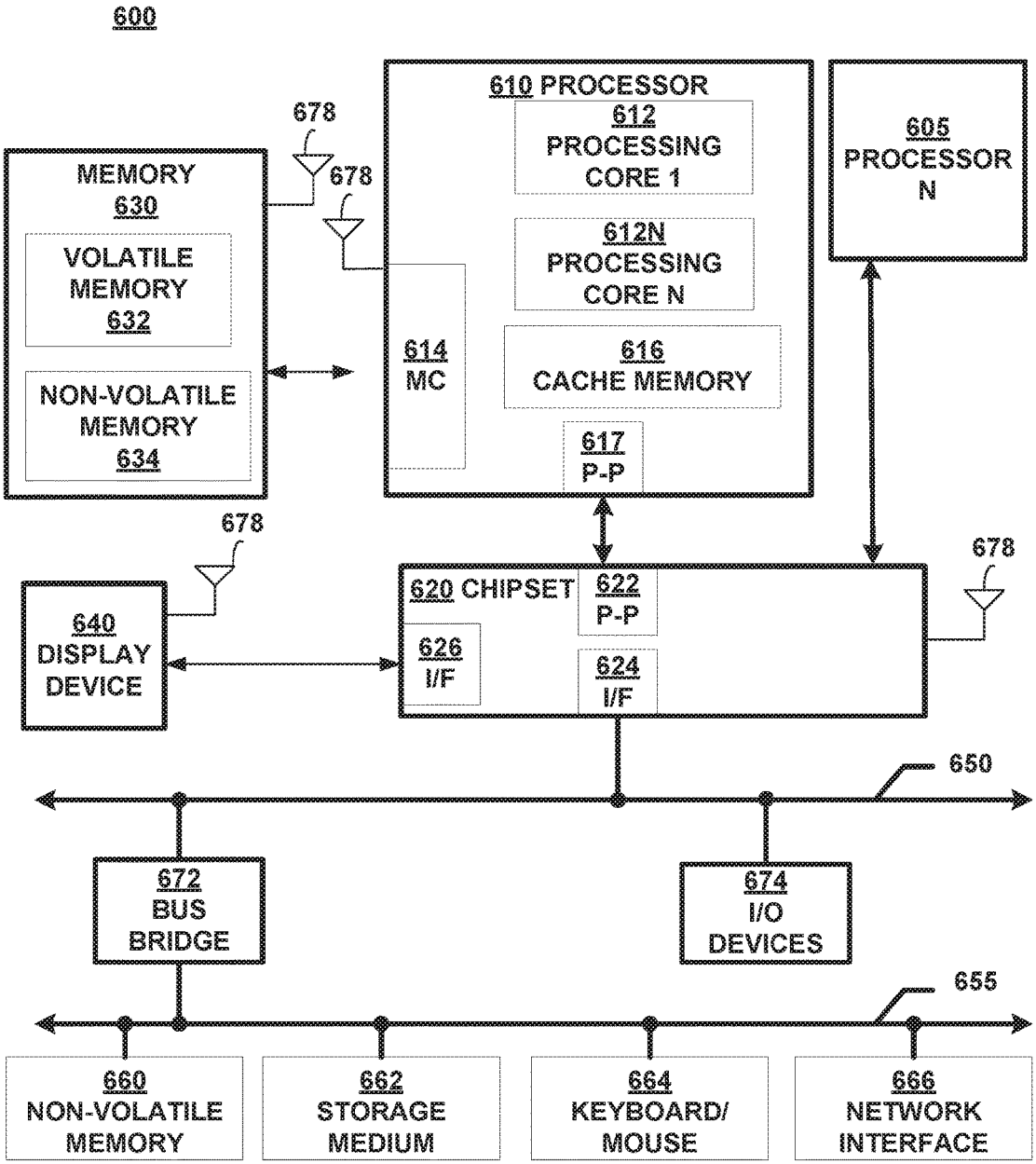
FIG. 6 shows a block diagram example of an electronic device which can include magnetic, conductive interconnects.

FIG. 6 illustrates, by way of example, a logical block diagram of an embodiment of an system 600 that includes components which can be included as part of the electronics 103A-B or can be communicatively or electrically coupled to the electronics 103A-B.

In one embodiment, processor 610 has one or more processing cores 612 and 612N, where 612N represents the Nth processor core inside processor 610 where N is a positive integer. In one embodiment, system 600 includes multiple processors including 610 and 605, where processor 605 has logic similar or identical to the logic of processor 610. In some embodiments, processing core 612 includes, but is not limited to, pre-fetch logic to fetch instructions, decode logic to decode the instructions, execution logic to execute instructions and the like. In some embodiments, processor 610 has a cache memory 616 to cache instructions and/or data for system 600. Cache memory 616 may be organized into a hierarchal structure including one or more levels of cache memory.

In some embodiments, processor 610 includes a memory controller 614, which is operable to perform functions that enable the processor 610 to access and communicate with memory 630 that includes a volatile memory 632 and/or a non-volatile memory 634. In some embodiments, processor 610 is coupled with memory 630 and chipset 620. Processor 610 may also be coupled to a wireless antenna 678 to communicate with any device configured to transmit and/or receive wireless signals. In one embodiment, the wireless antenna interface 678 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 632 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 634 includes, but is not limited to, flash memory, phase change memory (PCM), read-only memory (ROM), electrically erasable programmable read-only memory (EEPROM), or any other type of non-volatile memory device.

Memory 630 stores information and instructions to be executed by processor 610. In one embodiment, memory 630 may also store temporary variables or other intermediate information while processor 610 is executing instructions. In the illustrated embodiment, chipset 620 connects with processor 610 via Point-to-Point (PtP or P-P) interfaces 617 and 622. Chipset 620 enables processor 610 to connect to other elements in system 600. In some embodiments of the invention, interfaces 617 and 622 operate in accordance with a PtP communication protocol such as the Intel® QuickPath Interconnect (QPI) or the like. In other embodiments, a different interconnect may be used.

In some embodiments, chipset 620 is operable to communicate with processor 610, 605N, display device 640, and other devices. Chipset 620 may also be coupled to a wireless antenna 678 to communicate with any device configured to transmit and/or receive wireless signals.

Chipset 620 connects to display device 640 via interface 626. Display 640 may be, for example, a liquid crystal display (LCD), a plasma display, cathode ray tube (CRT) display, or any other form of visual display device. In some embodiments of the invention, processor 610 and chipset 620 are merged into a single SOC. In addition, chipset 620 connects to one or more buses 650 and 655 that interconnect various elements 674, 660, 662, 664, and 666. Buses 650 and 655 may be interconnected together via a bus bridge 672. In one embodiment, chipset 620 couples with a non-volatile memory 660, a mass storage device(s) 662, a keyboard/mouse 664, and a network interface 666 via interface 624 and/or 604, etc.

In one embodiment, mass storage device 662 includes, but is not limited to, a solid state drive, a hard disk drive, a universal serial bus flash memory drive, or any other form of computer data storage medium. In one embodiment, network interface 666 is implemented by any type of well-known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra Wide Band (UWB), Bluetooth, WiMax, or any form of wireless communication protocol.

While the components shown in FIG. 6 are depicted as separate blocks within the system 600, the functions performed by some of these blocks may be integrated within a single semiconductor circuit or may be implemented using two or more separate integrated circuits. For example, although cache memory 616 is depicted as a separate block within processor 610, cache memory 616 (or selected aspects of 616) can be incorporated into processor core 612.

Manufacturing, structure, materials, function, and other patch details are discussed in other applications, such as PCT Application PCT/US2016/040476, referenced supra.

ADDITIONAL NOTES AND EXAMPLES

Example 1 can include a device comprising a first substrate, at least one electric component on or at least partially in a first surface of the first substrate, an adhesive on the first surface of the first substrate to temporarily attached the device to skin of a user, a contact pad electrically coupled to an electric component of the at least one electric component, the contact pad on or at least partially in a second surface of the substrate, the first surface opposite the second surface, and a conductive magnetic connector electrically and mechanically connected to the contact pad through a first conductive adhesive.

In Example 2, Example 1 can further include, wherein the conductive magnetic connector includes a magnet with a conductive material on a surface of the magnet and electrically connected to the conductive adhesive.

In Example 3, at least one of Examples 1-2 can further include a fabric hook and loop fastener on the second surface.

In Example 4, Example 3 can further include, wherein the fabric hook and loop fastener is conductive.

In Example 5, at least one of Examples 1-4 can further include a snap connector on the second surface.

In Example 6, Example 5 can further include, wherein the snap connector is conductive.

In Example 7, at least one of Examples 1-6 can further include, wherein the conductive magnetic connector is a bipolar magnet that varies polarity in a z-direction.

In Example 8, at least one of Examples 1-6 can further include, wherein the conductive magnet is a bipolar magnetic connector that varies polarity in a y-direction or an x-direction.

In Example 9, at least one of Examples 1-8 can further include, wherein the conductive adhesive includes one of solder and conductive epoxy.

In Example 10, Example 2 can further include, wherein the conductive material includes one of solder and conductive epoxy.

In Example 11 a system includes a first device comprising a first substrate, at least one first electric component on or at least partially in a first surface of the first substrate, a first contact pad electrically coupled to an electric component of the at least one first electric component, the first contact pad on or at least partially in a second surface of the first substrate, the first surface opposite the second surface, and a first conductive magnetic connector electrically and mechanically connected to the first contact pad through a first conductive adhesive, and a second device comprising a second substrate, at least one second electric component on or at least partially in a first surface of the second substrate, a second contact pad electrically coupled to an electric component of the at least one second electric component, the second contact pad on or at least partially in a second surface of the second substrate, the first surface opposite the second surface, and a second conductive magnetic connector electrically and mechanically connected to the second contact pad through a second conductive adhesive, the second conductive magnetic connector including a first polarity opposite the first conductive magnetic connector such that when placed in proximity the first conductive magnetic connector and the second conductive magnetic connector form an electrical and mechanical connection.

In Example 12, Example 11 can further include, wherein the first conductive magnetic connector includes a magnet with a conductive material on a surface of the magnet and electrically connected to the conductive adhesive.

In Example 13, at least one of Examples 11-12 can further include, wherein the system further comprises one of (1) a fabric hook and loop fastener on the second surface of the first substrate and a mating fabric hook and loop fastener on the second surface of the second substrate and (2) a snap connector on the second surface of the first substrate and a mating snap connector on the second surface of the second substrate.

In Example 14, at least one of Examples 11-13 can further include, wherein one of (1) the first and second conductive magnetic connectors are bipolar magnetic connectors that vary polarity in a z-direction and (2). the first and second conductive magnetic connectors are bipolar magnetic connectors that vary polarity in a y-direction or an x-direction.

In Example 15, at least one of Examples 11-14 can further include, wherein the conductive material includes one of solder and conductive epoxy.

In Example 16 a system includes a first device comprising a first substrate, at least one first electric component on or at least partially in a first surface of the first substrate, the first electric component configured to produce signals indicative of a biological parameter of a user wearing the system, first electrical interconnect circuitry electrically connected to the at least one first electric component, the first electrical interconnect circuitry including conductive material in the first substrate, an adhesive on the first surface of the first substrate to temporarily attached the device to skin of a user, a first contact pad electrically connected to an electric component of the at least one first electric component through the first electrical interconnect circuitry, the first contact pad on or at least partially in a second surface of the first substrate, the first surface opposite the second surface, and a first conductive magnetic connector electrically and mechanically connected to the first contact pad through a first conductive adhesive, and a second device comprising a second substrate, at least one second electric component on or at least partially in a first surface of the second substrate, second electrical interconnect circuitry electrically connected to the at least one second electric component, the second electrical interconnect circuitry including conductive material in the second substrate, a second contact pad electrically connected to an electric component of the at least one second electric component through the second electrical interconnect circuitry, the second contact pad on or at least partially in a second surface of the second substrate, the first surface opposite the second surface, and a second conductive magnetic connector electrically and mechanically connected to the second contact pad through a second conductive adhesive, the second conductive magnetic connector including a first polarity opposite the first conductive magnetic connector such that when placed in proximity the first conductive magnetic connector and the second conductive magnetic connector form an electrical and mechanical connection.

In Example 17, Example 16 can further include, wherein the first substrate includes a flexible, stretchable material and the second substrate is a rigid substrate.

In Example 18, at least one of Examples 16-17 can further include, wherein the first conductive magnetic connector includes a magnet with a conductive material on a surface of the magnet and electrically connected to the conductive adhesive.

In Example 19, at least one of Examples 16-18 can further include, wherein the system further comprises one of (1) a fabric hook and loop fastener on the second surface of the first substrate and a mating fabric hook and loop fastener on the second surface of the second substrate and (2) a snap connector on the second surface of the first substrate and a mating snap connector on the second surface of the second substrate.

In Example 20, at least one of Examples 16-19 can further include, wherein one of (1) the first and second conductive magnetic connectors are bipolar magnets that vary polarity in a z-direction and (2). the first and second conductive magnetic connectors are bipolar magnets that vary polarity in a y-direction or an x-direction.

The above description of embodiments includes references to the accompanying drawings, which form a part of the description of embodiments. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) can be used in combination with each other. Other embodiments can be used such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above description of embodiments, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the description of embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A device comprising:

a substrate;

at least one electric component on or at least partially in a first surface of the substrate;

an adhesive on the first surface of the substrate to temporarily attached the device to skin of a user;

a plurality of contact pads electrically coupled to one or more electric components of the at least one electric component, the contact pad on or at least partially in a second surface of the substrate, the first surface opposite the second surface; and a plurality of conductive magnets external to the substrate and electrically and mechanically connected to a respective contact pad of the plurality of contact pads through a conductive adhesive, wherein adjacent conductive magnets of the plurality of conductive magnets are polarized in opposite directions.

2. The device of claim 1, wherein the conductive magnets includes a magnet with a conductive material, different from the magnet, on a surface of four sides of the magnet and in physical contact with the conductive adhesive.

3. The device of claim 1, further comprising a fabric hook and loop fastener on the second surface, the fabric hook and loop fastener near a periphery of the substrate.

4. The device of claim 3, wherein the fabric hook and loop fastener is conductive, and provides an electrical path to the at least one electric component.

5. The device of claim 1, further comprising a snap connector on the second surface, the snap connector near a periphery of the substrate.

6. The device of claim 5, wherein the snap connector is conductive, and provides an electrical path to the at least one electric component.

7. The device of claim 1, wherein the conductive magnets are bipolar magnets that vary polarity in a direction generally parallel to a surface of the contact pads.

8. The device of claim 1, wherein the conductive magnets are bipolar magnets that vary polarity in a direction generally perpendicular to a surface of the contact pads.

9. The device of claim 1, wherein the conductive adhesive includes one of solder and conductive epoxy.

10. The device of claim 2, wherein the conductive material includes a non-ferrous material.

11. A system comprising:

a first device comprising:

a first substrate;

at least one first electric component on or at least partially in a first surface of the first substrate;

a plurality of first contact pads electrically coupled to one or more electric components of the at least one first electric component, the plurality of first contact pads on or at least partially in a second surface of the first substrate, the first surface opposite the second surface; and a plurality of first conductive magnets external to the first substrate and electrically and mechanically connected to respective first contact pads of the plurality of first contact pads through a first conductive adhesive, wherein adjacent magnets of the plurality of first conductive magnets are polarized in opposite directions; and a second device comprising:

a second substrate;

at least one second electric component on or at least partially in a first surface of the second substrate;

a plurality of second contact pads electrically coupled to one or more electric components of the at least one second electric component, the plurality of second contact pads on or at least partially in a second surface of the second substrate, the first surface opposite the second surface; and a plurality of second conductive magnets external to the second substrate and electrically and mechanically connected to respective second contact pads of the plurality of second contact pads through a second conductive adhesive, the plurality of second conductive magnets including a first polarity same as a respective first conductive magnet of the plurality of first conductive magnets such that when placed in proximity, the respective first conductive magnet and the second conductive magnet form an electrical and mechanical connection on a side perpendicular to a surface of the plurality of second contact pads, wherein adjacent magnets of the plurality of second conductive magnets are polarized in opposite directions.

12. The system of claim 11, wherein the plurality of first conductive magnets includes a magnet with a conductive material on a surface of the magnet and electrically connected to the conductive adhesive.

13. The system of claim 11, wherein the system further comprises one of (1) a conductive fabric hook and loop fastener on the second surface of the first substrate and a mating conductive fabric hook and loop fastener on the second surface of the second substrate and provides an electrical path between the at least one first and second electric components and (2) a conductive snap connector on the second surface of the first substrate and a mating conductive snap connector on the second surface of the second substrate and provides an electrical path between the at least one first and second electric components.

14. The system of claim 11, wherein one of (1) the first and second conductive magnetic connectors are bipolar magnetic connectors that vary polarity in a direction generally parallel to a surface of the first and second plurality of contact pads and (2) the first and second conductive magnetic connectors are bipolar magnetic connectors that vary polarity in a direction generally perpendicular to a surface of the first and second plurality of contact pads.

15. The system of claim 12, wherein the conductive material includes one of solder and conductive epoxy.

16. A system comprising:

a first device comprising:

a first substrate;

at least one first electric component on or at least partially in a first surface of the first substrate, the first electric component configured to produce signals indicative of a biological parameter of a user wearing the system;

an adhesive on the first surface of the first substrate to temporarily attach the first device to skin of the user;

first electrical interconnect circuitry electrically connected to the at least one first electric component, the first electrical interconnect circuitry including conductive material in the first substrate;

a plurality of first contact pads electrically connected to one or more electric components of the at least one first electric component through the first electrical interconnect circuitry, the plurality of first contact pads on or at least partially in a second surface of the first substrate, the first surface opposite the second surface; and a plurality of first conductive magnets electrically and mechanically connected to respective first contact pads of the plurality of first contact pads through a first conductive adhesive, wherein adjacent magnets of the plurality of first conductive magnets are polarized in opposite directions; and a second device comprising:

a second substrate;

at least one second electric component on or at least partially in a first surface of the second substrate;

second electrical interconnect circuitry electrically connected to the at least one second electric component, the second electrical interconnect circuitry including conductive material in the second substrate;

a plurality of second contact pads electrically connected to one or more electric components of the at least one second electric component through the second electrical interconnect circuitry, the plurality of second contact pads on or at least partially in a second surface of the second substrate, the first surface opposite the second surface; and a plurality of second conductive magnets electrically and mechanically connected to respective second contact pads through a second conductive adhesive, wherein adjacent magnets of the plurality of second conductive magnets are polarized in opposite directions, the plurality of second conductive magnets including a first polarity opposite respective first conductive magnets of the plurality of first conductive magnets such that when placed in proximity, the respective first conductive magnets and the second conductive magnets form an electrical and mechanical connection.

17. The system of claim 16, wherein the first substrate includes a flexible, stretchable material and the second substrate is a rigid substrate.

18. The system of claim 16, wherein the plurality of first conductive magnets include a magnet with a conductive material on a surface of the magnet and electrically connected to the conductive adhesive.

19. The system of claim 16, wherein the system further comprises one of (1) a conductive fabric hook and loop fastener on the second surface of the first substrate and a mating conductive fabric hook and loop fastener on the second surface of the second substrate and provides an electrical path between the at least one first and second electric components and (2) a conductive snap connector on the second surface of the first substrate and a mating conductive snap connector on the second surface of the second substrate and provides an electrical path between the at least one first and second electric components.

20. The system of claim 16, wherein one of (1) the first and second conductive magnetic connectors are bipolar magnetic connectors that vary polarity in a direction generally parallel to a surface of the first and second plurality of contact pads and (2) the first and second conductive magnetic connectors are bipolar magnetic connectors that vary polarity in a direction generally perpendicular to a surface of the first and second plurality of contact pads.

* * * * *